US007263437B2

(12) United States Patent
Hirose et al.

(10) Patent No.: US 7,263,437 B2
(45) Date of Patent: Aug. 28, 2007

(54) VEHICLE DISPATCHING SYSTEM AND MANAGEMENT SERVER FOR THE SAME

(75) Inventors: Masahito Hirose, Musashino (JP); Tsuyoshi Souma, Saitama (JP); Yoshihiro Ogiso, Sagamihara (JP); Masaaki Aoki, Tokyo (JP)

(73) Assignees: NTT DoCoMo, Inc., Tokyo (JP); Tokyo MK Co., Ltd., Tokyo (JP)

( * ) Notice: Subject to any disclaimer, the term of this patent is extended or adjusted under 35 U.S.C. 154(b) by 186 days.

(21) Appl. No.: 10/803,462

(22) Filed: Mar. 18, 2004

(65) Prior Publication Data

US 2004/0236501 A1 Nov. 25, 2004

(30) Foreign Application Priority Data

Mar. 20, 2003 (JP) ..... 2003-077635

(51) Int. Cl.
*G01C 21/00* (2006.01)

(52) U.S. Cl. ..... 701/200; 701/25; 701/214; 701/300; 340/988; 340/902; 342/357.07; 342/357.09

(58) Field of Classification Search ..... 701/200, 701/201, 25, 208, 209, 214, 300; 340/988, 340/902, 904, 905; 342/357.01, 357.09
See application file for complete search history.

(56) References Cited

U.S. PATENT DOCUMENTS 6,882,290 B2 * 4/2005 French et al. ..... 340/988
2001/0050631 A1 12/2001 Takenaga ..... 342/357.13
2002/0193942 A1 12/2002 Odakura et al. ..... 701/207

FOREIGN PATENT DOCUMENTS

JP 2000-222690 A 8/2000

(Continued)

OTHER PUBLICATIONS

'Open i-Area' Manual Version 1.1, *NTT DoCoMo, Inc.*, Jul. 22, 2002, 3 Pages (with English Translation: total 5 pages).

(Continued)

*Primary Examiner*—Gertrude A. Jeanglaude
(74) *Attorney, Agent, or Firm*—Brinks Hofer Gilson & Lione

(57) ABSTRACT

The invention provides a useful vehicle dispatching system. Server 60 estimates an approximate location of a passenger on the basis of the area code transmitted from server 40. Server 60 transmits a list of landmarks located in the area corresponding to the area code, and the list is thereby provided to the passenger carrying mobile station 10. The passenger selects a desired landmark to which a vehicle should be dispatched. Server 60 determines the location of the landmark by referring to the landmark database; and determines which vehicles 20 are located proximate to the landmark by referring to the vehicle database. Server 60 transmits the information on the determined vehicles 20 to mobile station 10, and the information is thereby provided to the passenger. The passenger selects a desired vehicle 20 to make a telephone call to the driver of vehicle 20. Thus, the passenger may directly talk to the driver.

28 Claims, 13 Drawing Sheets

FOREIGN PATENT DOCUMENTS

| | | | |
|---|---|---|---|
| JP | 2001-344316 | A | 12/2001 |
| JP | 2001-346246 | A | 12/2001 |
| JP | 2002-008194 | A | 1/2002 |
| JP | 2002-009946 | A | 1/2002 |
| JP | 2002-032898 | A | 1/2002 |
| JP | 2002-133588 | A | 5/2002 |
| JP | 2002-149527 | A | 5/2002 |
| JP | 2002-279589 | A | 9/2002 |
| JP | 2002-352388 | A | 12/2002 |
| JP | 2002-357448 | A | 12/2002 |
| JP | 2002-367085 | A | 12/2002 |
| JP | 2003-067889 | A | 3/2003 |

OTHER PUBLICATIONS

Chinese Office Action, CN Patent App. No. 200410030227.7, Jul. 14, 2006.

* cited by examiner

FIG. 3

| VEHICLE ID | VEHICLE TYPE | LOCATION COORDINATES | TELEPHONE NUMBER OF MS 23 |
|---|---|---|---|
| S001 | SEDAN | N○○○○○○○○, E×××××××× | 090-△△△△-△△△△ |
| W020 | WAGON | N○○○○○□□○, E××○○××× | 090-□□□□-□□□□ |
| H003 | LIMOUSINE | N○○○○××○○, E××××△△×× | 090-○○○○-○○○○ |
| ..... | ..... | ..... | ..... |
| ..... | ..... | ..... | ..... |
| ..... | ..... | ..... | ..... |
| ..... | ..... | ..... | ..... |
| ..... | ..... | ..... | ..... |

FIG. 4

| AREA CODE | LANDMARK NAME | LANDMARK TYPE | LANDMARK ID | LOCATION COORDINATES |
|---|---|---|---|---|
| AREA0001 (AKASAKA) | AKASAKA INTERNATIONAL BUILDING | OTHER LANDMARK | LAND0001 | N×××××××××, E○○○○○○○○ |
| | SANNO PARK TOWER BUILDING | OTHER LANDMARK | LAND0002 | N×××××××△, E○○○○○○○× |
| | AKASAKA-MITSUKE | STATION | LAND0003 | N××××××○, E○○○○○○○□ |
| | AT OFFICIAL RESIDENCE OF THE PRIME MINISTER | STREET CROSSING | LAND0004 | N××××××○○, E○○○○○○△△ |
| AREA0002 (ROPPONGI) | ..... | ..... | ..... | ..... |
| | ..... | ..... | ..... | ..... |
| | ..... | ..... | ..... | ..... |
| | ..... | ..... | ..... | ..... |
| ..... | ..... | ..... | ..... | ..... |
| ..... | ..... | ..... | ..... | ..... |
| ..... | ..... | ..... | ..... | ..... |

FIG. 5

| FULL NAME | AGE | GENDER | TELEPHONE NUMBER OF MS 10 | PASSENGER ID | PASSWORD | REGISTERED LANDMARKS | |
|---|---|---|---|---|---|---|---|
| NAKAMURA, TARO | 36 | MALE | 090-××××-×××× | nakamura | abc123 | HOME | N○○○○○×○○, E×○×××××× |
| | | | | | | OFFICE | N○○○○○□□○, E××○○×○×× |
| | | | | | | Y HOSPITAL | N××○○○○○○, E○○×××××× |
| YAMADA, AKIKO | 26 | FEMALE | 090-◇◇◇◇-◇◇◇◇ | yamada | rgymkl | ..... | ..... |
| ..... | ... | .... | ..... | ..... | ..... | ..... | ..... |
| ..... | ... | .... | ..... | ..... | ..... | ..... | ..... |
| ..... | ... | .... | ..... | ..... | ..... | ..... | ..... |
| ..... | ... | .... | ..... | ..... | ..... | ..... | ..... |

FIG. 6

| DATE AND TIME OF QUERY | LANDMARK NAME | AREA CODE | PASSENGER ID | VEHICLE ID | ..... | ..... |
|---|---|---|---|---|---|---|
| 2003/1/27 | AKASAKA INTERNATIONAL BUILDING | AREA0001 | nakamura | S001 | ..... | ..... |
| 2003/1/28 | TOKYO TOWER | AREA0025 | yoshida | W052 | ..... | ..... |
| ..... | ..... | ..... | ..... | ..... | ..... | ..... |
| ..... | ..... | ..... | ..... | ..... | ..... | ..... |
| ..... | ..... | ..... | ..... | ..... | ..... | ..... |
| ..... | ..... | ..... | ..... | ..... | ..... | ..... |
| ..... | ..... | ..... | ..... | ..... | ..... | ..... |

VEHICLE DISPATCHING SYSTEM AND MANAGEMENT SERVER FOR THE SAME

TECHNICAL FIELD

The present invention relates to a system for dispatching passenger transportation vehicles.

Recently, cellular phones which are provided with a function for determining a location in which they are used have come into use. By use of such functionality it has become possible to provide a system by which a location of a passenger carrying a cellular phone can be determined for dispatch of a taxicab or the like to the location of the passenger. Refer to, for example, Japanese patent publication JP-A-2002-133588.

A number of cellular phones are now equipped with GPS (Global Positioning System) functionality. However, a drawback to such phones is that they require both an antenna and arithmetic/logic unit dedicated for use with GPS measurements, with the result that they are both large and expensive.

Another method which is used for determining a location of a cellular phone, relies on a wireless communication cell in which a cellular phone is located. In other words, a location of a cellular phone is correlated to a location of communication cell. However, again, such a method suffers from a drawback in that an area covered by the communication cell may be anywhere from between several tens of meters (in the case of the communication micro cell used in the Personal Handy Phone system, for example) to several kilometers. Consequently, only an approximate location of a user can be determined, and the method is therefore not applicable for use in a service which requires that a relatively precise determination of a location be made so that, for example, a taxicab can be dispatched to a passenger location.

'i-AREA (Registered Trade Mark)' is a name of a service provided by NTT DoCoMo inc., by use of which a user of an appropriate cellular phone is able to obtain information on his or her location. In utilization of this service, a server on a network transmits to a cellular phone, relative to wireless communication cell in which the cellular phone is located, a list of place names which are determined to be within a predetermined vicinity of the cellular phone. The user of the cellular phone selects from the place list displayed on his or her phone an appropriate place name; and the server then transmits to the cellular phone information on the location designated by the place name, and the location related information is then displayed on the cellular phone. In this way, a user can obtain information on proximate commercial establishments, such as a restaurant or a karaoke bar.

However, in using this method, locations of wireless communication cells are also used to determine an approximate location of the cellular phone in i-AREA service. Consequently, this service is also not suitable for use in dispatching a taxicab to a passenger.

SUMMARY

The present invention provides a system for dispatching a vehicle to a passenger, the system including: a mobile station carried by the passenger; vehicle location storage means for storing locations of a plurality of vehicles, the plurality of vehicles being able to provide the passenger with a passenger transport service; landmark storage means for storing a first number of landmark identifiers with respect to an area, each of the first number of landmark identifiers designating a landmark located in the area, and the area being defined in accordance with predetermined parameters; area determination means for determining, on the basis of the locations of communication facilities communicating with said mobile station in a mobile communication network, the area in which the mobile station is located; landmark transmission means for extracting a second number of landmark identifiers from the first number of landmark identifiers stored in the landmark storage means, and for transmitting the extracted second number of landmark identifiers to said mobile station, each of the second landmark identifiers designating a landmark located in the area determined by the area determination means; and vehicle determination means for determining, on the basis of the locations of vehicles stored in the vehicle location storage means, one or more vehicles located within a predetermined distance from the landmark designated by the landmark identifier, the landmark identifier being selected by the passenger from the received second number of landmark identifiers. Thus, the system enables to provide a passenger with a list of landmarks near the passenger and to dispatch a vehicle to the location of the landmark selected by the passenger from among the listed landmarks According to the present invention, the system may further include vehicle information transmitting means for transmitting vehicle information on the vehicle determined by the vehicle determination means, wherein the vehicle information is displayed on the display of the mobile station. The vehicle information may include distance information designating the distance between the location of the vehicle determined by the vehicle determination means and the location of the landmark designated by the landmark identifier selected by the passenger. The distance information is useful, when the passenger selects a vehicle.

The vehicle information may also include contact information required to communicate between the passenger and the driver of the vehicle determined by the vehicle determination means. Thus, the passenger may contact directly with the driver of a vehicle by using the contact information.

According to the present invention, the system may store information on the vehicles determined by the vehicle determination means, information on the area determined by the area determination means, information on the landmark designated by the landmark identifier extracted by the landmark transmission means, and information on the passenger. The information thus stored has a variety of uses. For example, the information can be used to determine demands for a passenger transport service, and in particular to determine an area in which a greatest demand exists, or to enable a passenger and/or a driver to confirm a location to which the vehicle should be dispatched.

The present invention provides: a management server having vehicle location storage means for storing locations of a plurality of vehicles, the plurality of vehicles being able to provide the passenger with a passenger transport service; landmark storage means for storing a first number of landmark identifiers with respect to an area, each of the first number of landmark identifiers designating a landmark located in the area, and the area being defined in accordance with predetermined parameters; landmark transmission means for extracting a second number of landmark identifiers from the first number of landmark identifiers stored in the landmark storage means, and for transmitting the extracted second number of landmark identifiers to the mobile station, each of the second number of landmark identifiers designating a landmark located in the area in which the mobile station is located; and vehicle determination means for determining, on the basis of the locations of vehicles stored in the vehicle location storage means, vehicles located within a predetermined distance from the landmark designated by the landmark identifier transmitted from the mobile station.

The present invention also provides a computer program, the program functioning to cause a computer to extract landmark identifiers, each designating a landmark located in the area designated by the area code transmitted from an external apparatus; to transmit the extracted landmark identifiers to a mobile station via a transmitting means; and to determine, on the basis of the location of the vehicle stored in the storing means, one or more vehicles located proximate to the landmark designated by the landmark identifier transmitted from the mobile station. The computer program can be stored on any computer readable storage medium.

As will be understood from the foregoing description, the present invention enables a driver and a passenger to communicate with one another by using respective mobile stations.

BRIEF DESCRIPTION OF DRAWINGS

FIG. 3 is a chart illustrating contents of a vehicle database stored in the management server shown in FIG. 2.

FIG. 4 is a chart illustrating contents of a landmark database stored in the management server shown in FIG. 2.

FIG. 5 is a chart illustrating contents of a passenger database stored in the management server shown in FIG. 2.

FIG. 6 is a chart illustrating contents of a log database stored in the management server shown in FIG. 2.

PREFERRED EMBODIMENT

Figure 1:
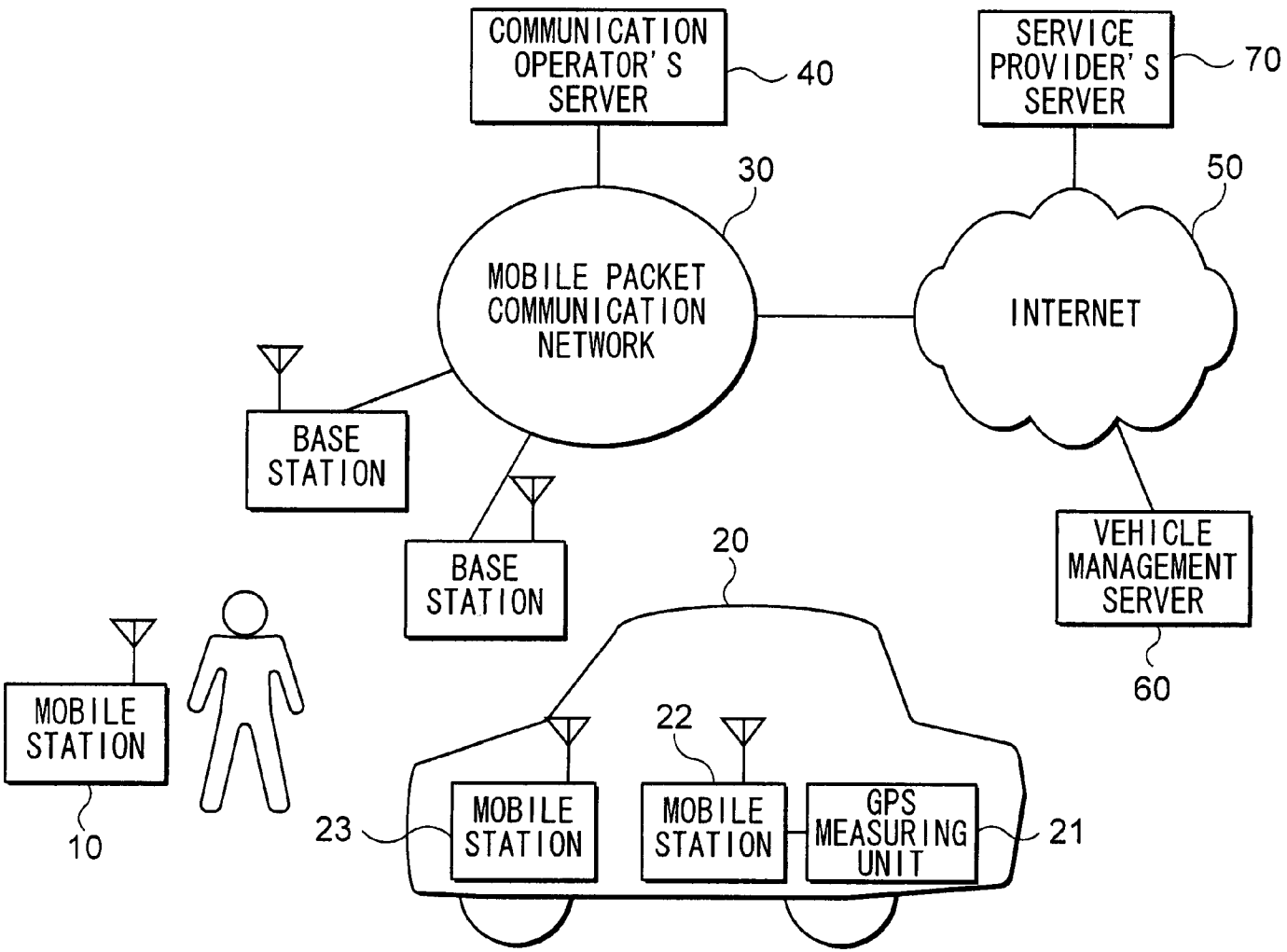
FIG. 1 is a block diagram illustrating a configuration of a vehicle dispatching system according to an embodiment of the present invention.

A preferred embodiment of the present invention will now be described with reference to drawings. Like numerals will be used to designate like elements depicted in the drawings.

A. Configuration

FIG. 1 is a block diagram illustrating the complete configuration of the vehicle dispatching system according to one embodiment of the present invention. As shown in FIG. 1, the vehicle dispatching system includes mobile station 10, which a passenger carries; mobile station 22, which is connected to a GPS measuring unit 21 installed on vehicle 20; mobile station 23, which the driver of vehicle 20, for example a taxicab, carries; network 30, which provides mobile station 10 and mobile station 22 with a wireless mobile packet communication service; server 40, which is connected to network 30; and servers 60 and 70, which are connected to the Internet 50. The system also includes wireless mobile telephone network, (not shown in FIG. 1), which provides mobile station 10 and mobile station 23 with a telephone service. Network 30 is connected to the Internet 50 via a gateway, (also not shown in FIG. 1). Thus bidirectional data communication is able to be performed between network 30 and the Internet 50.

In the present embodiment, server 40 can be operated and managed by the communication operator of network 30. Server 60 can be operated and managed by an enterprise providing a taxicab service or an ASP (Application Service Provider). Server 70 can be operated and managed by a service provider, which specializes in providing a service for monitoring a location of mobile station 22, corresponding, namely, to a location of vehicle 20.

Mobile stations 10, 22 and 23 may be cellular phones either of PDC (Personal Digital Cellular) system, GSM (Global System for Mobile Communication) system or IMT-2000 (International Mobile Telecommunication 2000) system; or may be a personal handy phone. Mobile station 10 has a browsing function, which enables CPU (Central Processing Unit) of mobile station 10 to access to a server connected to the Internet 50 via network 30, and to obtain data formatted in HyperText Markup Language (hereafter HTML) from the server, and to parse the HTML data and display information corresponding to the HTML data on a LCD (Liquid Crystal Device) display of mobile communication terminal 10. Browser software is stored in a nonvolatile memory of mobile station 10. Mobile station 10 is capable of telephone communication via a mobile telephone network; and mobile station 22 is capable of telephone communication via the same or other compatible mobile telephone networks. Thus, the passenger carrying mobile station 10 and the driver of vehicle 20 carrying mobile station 22 are capable of telephone communication each other. Mobile station 23 is capable of communicating via either network 30 or other wireless communication networks so as to enable dispatch of, for example, a taxicab.

Server 40 is configured as a conventional server apparatus, and includes a CPU, various types of memory, and various communication ports. In the various memories HTML data are stored, the data corresponding to information displayed on the LCD display of mobile station 10; World Wide Web server software, which communicates with mobile station 10 using HyperText Transfer Protocol HTTP; and programs processing information on the location of mobile station 10, corresponding to the location of the passenger carrying mobile communication terminal 10. The CPU of server 40 executes the programs stored in the memories of server 40, such that CPU carries out the function of notifying server 60 of the area code assigned to the base station wireless communicating with mobile station 10.

In the present embodiment, an area code is assigned to each base station shown in FIG. 1. On receiving a message transmitted from mobile station 10, each base station adds its area code to the message and transmits the message to the switch station to which each base station connects. In the present embodiment, an area code is not assigned uniquely to a base station, and can be assigned to a plurality of base stations which are located in the same area defined according to a criterion such as an addressing scheme. For example, a plurality of base stations may be located in an area the address of which includes 'Akasaka, Minato-ku, TOKYO', so that these plurality of base stations store an area code in common. Thus, an approximate location of mobile station 10 may be determined on the basis of an area code included in a message transmitted from mobile station 10.

GPS unit 21 installed in vehicle 20 includes a GPS antenna and an arithmetic/logic unit (not shown in FIG. 1). The location of vehicle 20 is determined by using GPS unit 21. GPS unit 21 receives GPS signals transmitted from a plurality of GPS satellites via the GPS antenna. The arithmetic/logic unit of GPS unit 21 then computes location coordinates of vehicle 20 on the basis of messages included in the received signals. The location coordinates thus computed are periodically transmitted from GPS unit 21 to server 70 via mobile station 22, which is linked to GPS unit 21 via a communication cable.

Server 70 is configured as hardware used in a general server apparatus including a CPU and various types of memory. Server 70 stores the location coordinates of vehicle 20 received via communication network 30 and Internet 50 in association with a vehicle ID assigned to the vehicle 20. Responsive to periodical requests received from server 60, the location coordinates of vehicle 20 stored in server 70 are notified to the server 60.

Figure 2:
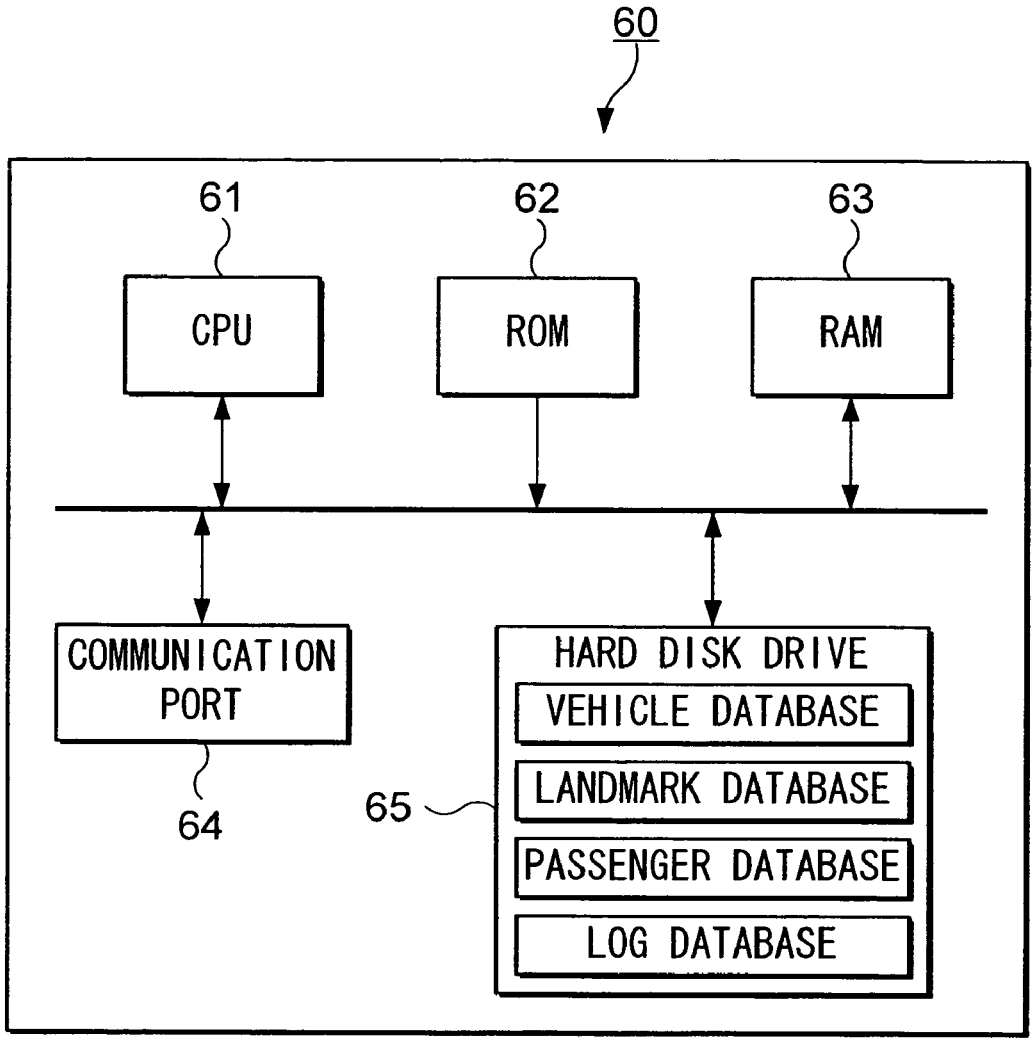
FIG. 2 is a block diagram illustrating a configuration of a management server in the system shown in FIG. 1.

Next, the configuration of server 60 will be described in detail. Server 60 includes CPU 61, ROM (Read Only Memory) 62, RAM (Random Access Memory) 63, communication port 64, and hard disk drive 65, as shown in FIG. 2. Hard disk drive 65 stores HTML (HyperText Markup Language) data for display by mobile station 10; and WWW (World Wide Web) server software which is used to communicate with mobile station 10 according to HTTP (HyperText Transfer Protocol). Hard disk drive 65 also stores a variety of databases, including a vehicle database, a landmark database, a passenger database, and a log database, as well as database management software for generating, updating, and searching records in the data bases.

FIG. 3 is a chart illustrating the contents of the vehicle database. The vehicle database contains a record of vehicle 20 including: an assigned vehicle ID; type of vehicle; location coordinates indicating the vehicle's location; and a telephone number of mobile station 23 carried by the vehicle's driver. In the present example shown in FIG. 3, a first record designates that a vehicle 20 having ID S001 assigned is a sedan-type vehicle; the vehicle 20 is located at N (NORTH)—latitude and E (EAST)—longitude; and the telephone number of mobile station 23 carried by the driver of the vehicle 20 is 090 ( - - - ) - - - . In this example, the first character of the vehicle ID 'S' indicates that the vehicle 20 is a sedan-type vehicle; 'W' indicates that the vehicle 20 is a wagon-type vehicle; and 'H' indicates that the vehicle 20 is a limousine-type vehicle. A vehicle ID, a type of vehicle, and a telephone number of mobile station 23 corresponding to vehicle 20, are stored in a record of the vehicle by an enterprise providing a taxicab service or an operator of ASP; further, location coordinates of vehicle 20 are periodically obtained by server 60 from server 70 via Internet 50.

FIG. 4 is a chart illustrating contents of the landmark database. The landmark database contains a record of an area including information on landmarks located in the area. In the present embodiment, landmarks are landmark objects and/or landmarks which are readily recognizable to people. Thus, landmarks may include, for example, a station, a street crossing, a skyscraper, a large scale facility, as well as natural terrains such as mountain paths, ponds and the like.

In the present example as shown in FIG. 4, the area assigned to the area code 'AREA0001' corresponds to an area the address of which includes 'Akasaka, Minato-ku, TOKYO'; location landmarks such as Akasaka International Building, Sannou Park Tower building, Akasaka-Mitsuke station; and the street crossing in front of the official residence of the prime minister. Landmark IDs, LAND0001, LAND0002, LAND0003, LAND0004, are uniquely assigned to these landmarks, respectively. Type of landmarks include 'station', 'street crossing', and 'other landmarks'. In the example shown in FIG. 4, the first record designates that Akasaka international building is located at N (NORTH)—latitude and E (EAST)—longitude. This information is stored in the record of the area database by an enterprise providing a taxicab service or by an operator of ASP.

In the present embodiment, server 60 estimates an approximate location of a passenger on the basis of an area code included in the message transmitted from server 40. Server 60, then, transmits to mobile station 10, a list of landmarks located in the area corresponding to the approximate location of the passenger, and the list is thereby provided to the passenger carrying mobile station 10. The passenger selects a landmark from the list displayed on mobile station 10, so as to specify a desired location to which a vehicle should be dispatched. When server 60 receives, from mobile station 10, a request including a landmark selected by the passenger, server 60 determines the location of the selected landmark by referring to the landmark database, as shown in FIG. 4. Server 60 determines, by referring to the vehicle database, that vehicle 20 is located proximate to the selected landmark. Server 60, then, transmits information on the determined vehicle 20 to mobile station 10, and the information is thereby provided to the passenger carrying mobile station 10.

FIG. 5 is a chart illustrating contents of the passenger database. In the present embodiment, a passenger transport service including a taxicab service is provided only to a passenger who has subscribed to the service. Thus, the passenger database contains a record of the passenger. In the present example shown in FIG. 5, a first record designates personal information of a passenger, such that the passenger named NAKAMURA, Taro is a 36 year old male, and that the telephone number of his mobile station 10 is 090 ( - - - ) - - - , as well as relevant authentication information such as his passenger ID 'nakamura' and his password 'abc123'. The authentication information is used by server 60 to confirm whether a passenger who has requested dispatch of vehicle 20 using mobile station 10, is a passenger who has subscribed to the service.

The record of the passenger database also includes information on registered landmarks, which are registered by the passenger. For example, a passenger who frequently uses a passenger transport service from a work place to home, may register the work place with server 60 as a registered landmark beforehand and select the work place from among the registered landmarks so as to search for a vehicle 20 proximate to the work place.

Accordingly, in the example shown in FIG. 5, the first record of the passenger database corresponding to the passenger having the passenger ID 'nakamura' includes registered landmarks such as 'home', 'work place', and 'Y hospital' and their associated location coordinates. All of this passenger information is stored at an enterprise providing a taxicab service, or by an operator of ASP, in the record of the passenger database in server 60 on the basis of a passenger's declaration.

FIG. 6 is a chart illustrating contents of the log database. The log data base includes information on search results when passenger accesses server 60 by using mobile station 10 so as to search vehicle 20 located proximate to an appointed landmark. In the present example shown in FIG. 6, a first record designates that a search was performed by the passenger having the passenger ID 'nakamura' in the area designated by the area code 'Akasaka' on Jan. 27, 2003, for searching a vehicle 20 which is located most proximate to the landmark 'Akasaka International Building' and the search result, that a vehicle 20 having the vehicle ID 'ID0001' is found to be a vehicle 20 which is the most proximate. The records stored in the log database may be used for a variety of purposes, for example, in a case when an enterprise providing a taxicab service wishes to investigate passenger demand in an area (particularly to determine the area most demands for vehicle 20 exist, for example), or in a case when a passenger and/or a driver wishes to confirm a location to which the vehicle should be dispatched.

B. Operation

Figure 7:
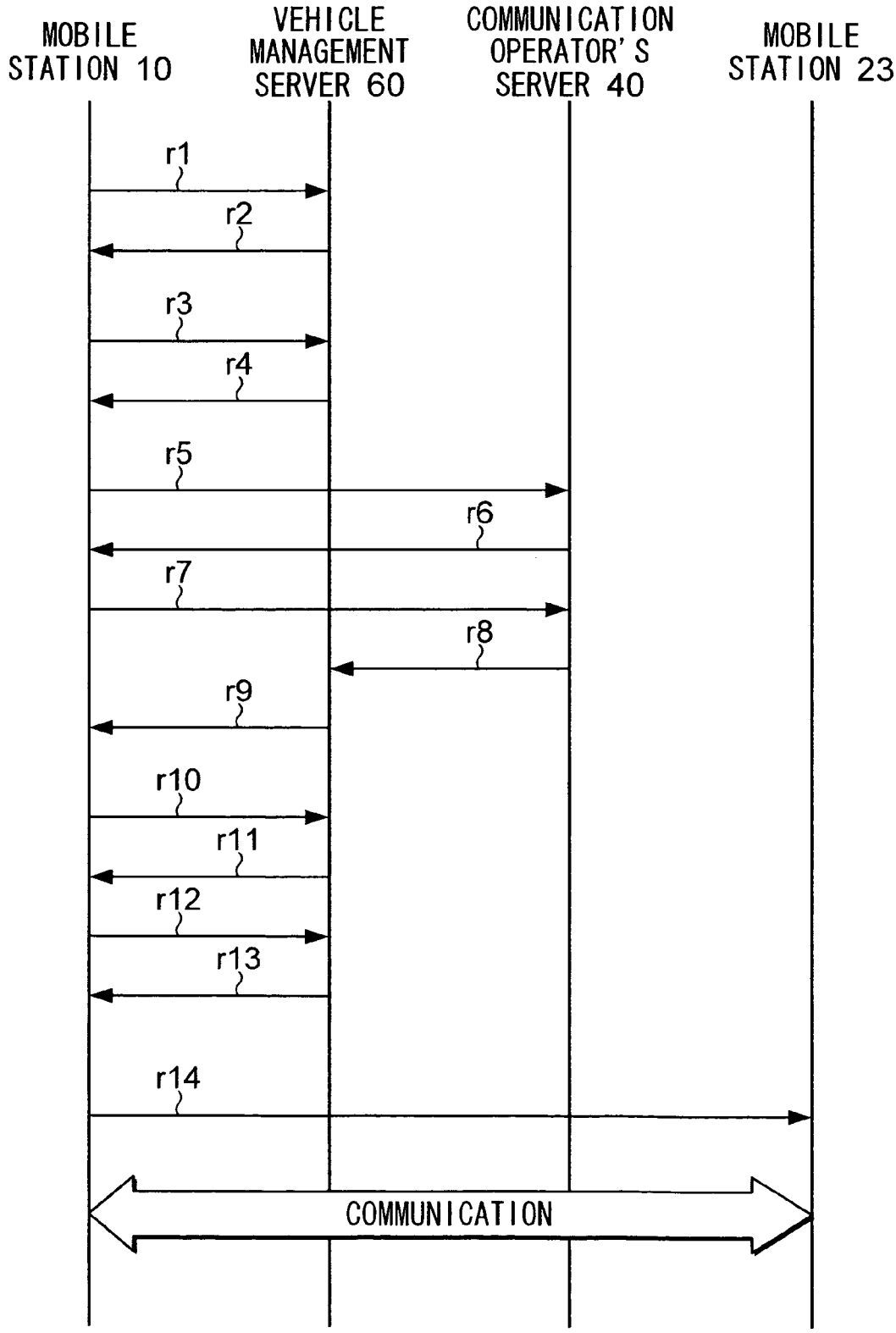
FIG. 7 is a sequence diagram illustrating an operational sequence in the system shown in FIG. 1.

The operation of the system having the above-described configuration will now be described with reference to the sequence diagram shown in FIG. 7.

A passenger carrying mobile station 10 manipulates his/her mobile station 10 so as to launch browsing software and to access server 60. Mobile station 10 then generates HTTP request r1 and transmits it to server 60. On receiving request r1, server 60 reads out HTML data from hard disk drive 65 and transmits HTTP response r2 including the HTML data to mobile station 10. The HTML data is used to display a prompt dialog on mobile station 10 requesting the passenger to input his/her passenger ID and password.

Mobile station 10 interprets HTML data included in the received HTTP response r2 and displays a prompt dialog having an input field for a passenger ID and an input field for a password. The passenger inputs his/her passenger ID 'nakamura' and password 'abc123' in the input fields and carries out the required steps for transmission. Mobile station 10 then transmits HTTP request r3 including the passenger ID and the password to server 60.

Upon receipt, Server 60 compares the passenger ID 'nakamura' and the password 'abc123' included in the received HTTP request r3 with the passenger ID 'nakamura' and the password 'abc123' contained in the passenger database as shown in FIG. 5, so as to confirm that the entries coincide and that the passenger is authorized to use the requested service.

Server 60 reads out from hard disk drive 65 the predetermined HTML data to be transmitted, and transmits a HTTP response r4 including the HTML data to mobile station 10.

Figure 8:
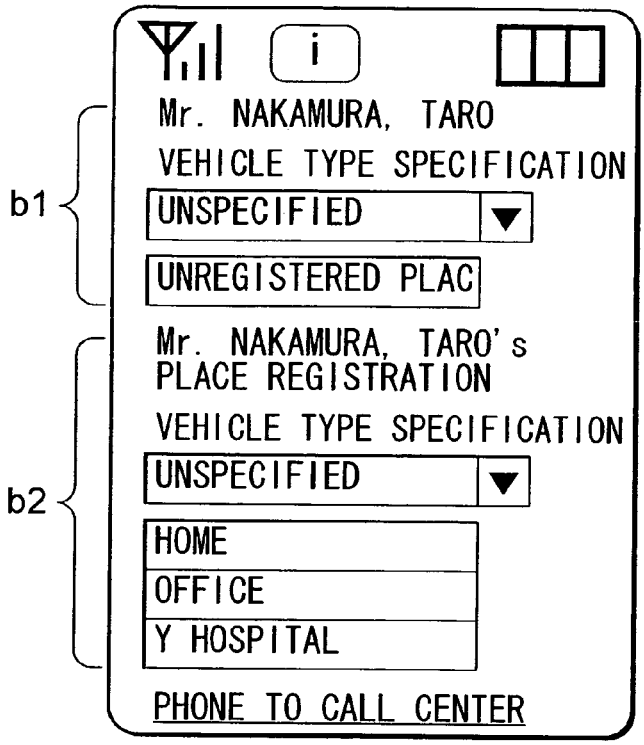
FIGS. 8-19 are charts, each illustrating an image displayed on the mobile station in the system shown in FIG. 1.

Mobile station 10 interprets HTML data included in the received HTTP response r4, and displays a screen image as shown in FIG. 8. Information displayed in the portion b1 of the screen is used when the passenger searches a proximate vehicle 20. Information displayed in the portion b2 of the screen is used when the passenger searches for a vehicle 20 proximate to a pre-registered landmark.

The first case will be described as an example of when a passenger searches for a vehicle 20 which is at a proximate location.

Figure 9:
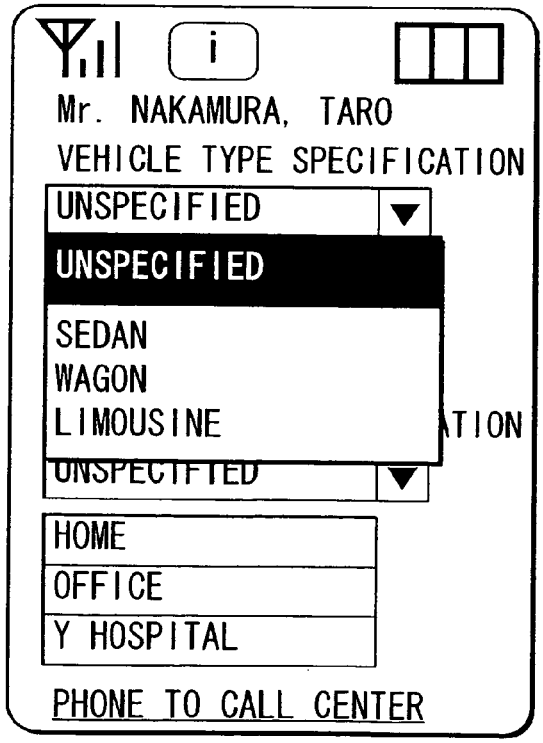
Figure 10:
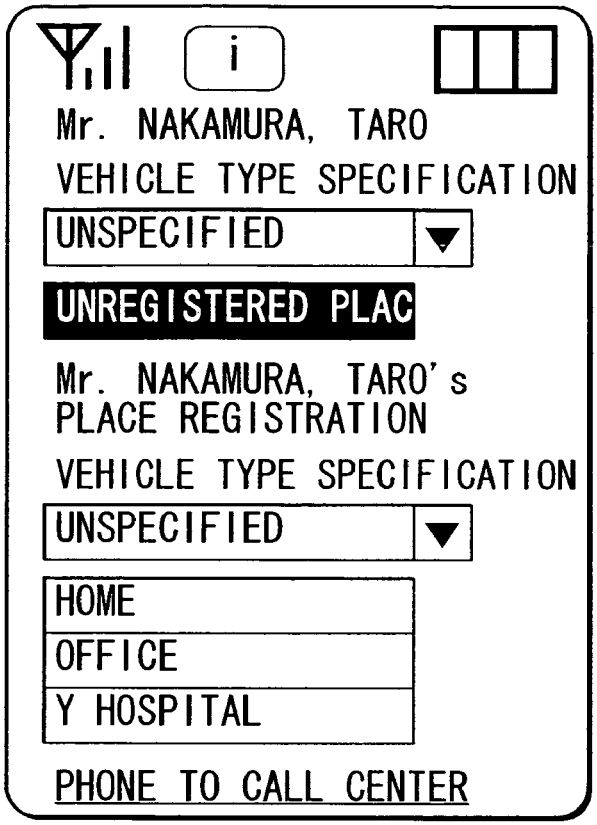

The passenger selects 'unspecified' for the type of vehicle from a pull-down list, as shown in FIG. 9. The passenger then manipulates the predetermined steps to select the field containing the characters 'unspecified', as shown in FIG. 10. Mobile station 10, then, transmits to server 40 HTTP request r5, so as to search for the location of mobile station 10 itself. As described above, the area code 'AREA0001' is added to the HTTP request in the process of transmitting within network 30.

Server 40 determines that mobile station is located in the area 'Akasaka' on the basis of area code 'AREA0001' included in the received HTTP request r5. Server 40, then, transmits HTTP response r6 including the HTML data corresponding to the determined results to mobile station 10.

Figure 11:
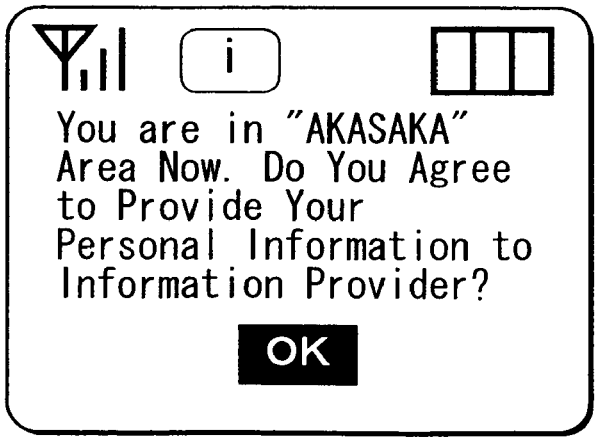

Mobile station 10 interprets the HTML data included in the received HTTP response r6, and displays a confirmation dialog as shown in FIG. 11. This confirmation dialog is provided so as to enable the passenger to confirm permission of transmission of his/her current location outside network 30; the information being personal. The passenger carries out the predetermined steps to select the OK-button, as shown in FIG. 11. Mobile station 10 so as to transmit HTTP request r7 to server 40.

On receiving HTTP request r7, server 40 transmits HTTP request r8 including the area code 'AREA0001' to server 60.

On receiving HTTP request r8, server 60 generates HTML data on the basis of the area code 'AREA0001' included in the HTTP request r8, and transmits HTTP response r9 including the HTML data to mobile station 10. The HTML data is used to generate a screen image for display on mobile station 10 for the passenger to select an area to which a vehicle 20 should be dispatched.

Figure 12:
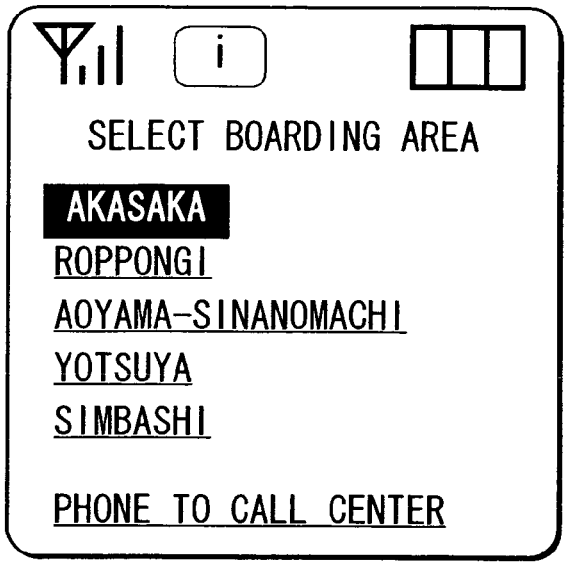

Mobile station 10 interprets the HTML data included in the received HTTP response r9, and displays a screen image as shown in FIG. 12. In the present example, the passenger would be currently located in the area 'Akasaka' corresponding to the area code 'AREA0001'. Nevertheless, area names of adjacent and/or nearby areas, such as 'Roppongi' and 'Aoyama' are displayed for selection in the screen image, as shown in FIG. 12. One of the reasons for this displaying scheme is that the passenger may wish vehicle 20 to be dispatched to a location which is different from the current location. For example a passenger who is currently located in the area 'Akasaka' may wish to go shopping through to the area 'Roppongi' and catch vehicle 20 there.

The area name 'Akasaka' shown on the screen image represented in FIG. 12 is associated with the area code 'AREA0001'. The passenger manipulates the predetermined steps to select the area name 'Akasaka'. Mobile station 10, then, transmits HTTP request r10 including the area code 'AREA0001' to server 60.

On receiving HTTP request r10, server 60 extracts a plurality of (three, in the present example ) vehicles 20 located in the area 'Akasaka' designated by the area code 'AREA0001' included in the HTTP request r10, from the vehicle database shown in FIG. 3. In the present example, the type of vehicle is unspecified. Accordingly, vehicles 20 of a variety of types of vehicle are extracted, having vehicle ID, 'S001', 'S002', and 'S003'.

Server 60 extracts information on landmarks associated with the area code 'AREA0001', from the landmark database.

Server 60 generates HTML data including those three vehicle ID's and the information on landmarks, and transmits HTTP response r11 including the generated HTML data to mobile station 10.

Figure 13:
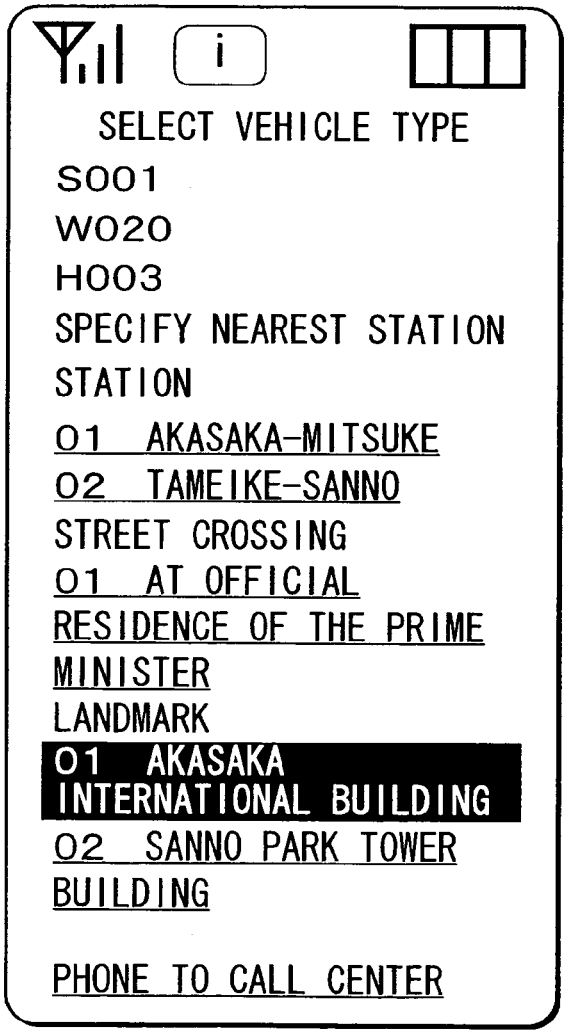

Mobile station interprets the HTML data included in the received HTTP response r11, and displays a screen image as shown in FIG. 13. As shown in FIG. 13, the vehicle ID's 'S001', 'S002', and 'S003' of the vehicles located in the area 'Akasaka' are shown in the screen, as well as landmarks such as 'Akasaka-Mitsuke station' located in the area 'Akasaka' are displayed. The passenger manipulates the predetermined steps to select the vehicle 20 having the vehicle ID 'S001'. Then the operation advances to the process handling the connection from the passenger to the driver of vehicle 20. Details of the process will be described afterward.

The next case will be described, when a passenger selects a landmark to which vehicle 20 should be dispatched on the screen shown in FIG. 13. In the present example, the passenger manipulates the predetermined steps to select the landmark 'Akasaka international building', to which the landmark ID 'LAND0001' is assigned. Mobile station 10, then, transmits HTTP request r12 including the landmark ID 'LAND0001' to server 60.

On receiving HTTP request r12, server 60 extracts the landmark ID 'LAND0001' included in the HTTP request r12, and reads out the location coordinates corresponding to the landmark ID 'LAND0001', N (NORTH)—latitude and E (EAST)—longitude, from the landmark database shown in FIG. 4. Server 60 calculates the distance between the landmark and vehicle 20, on the basis of the location coordinates, 'N (NORTH)—latitude and E (EAST)—longitude', and the location coordinates of the vehicle 20, referring to the vehicle database as shown in FIG. 3.

Server 60 determines the vehicle ID assigned to the vehicle 20 which locates most proximate to the landmark, on the basis of the calculated distance. Thus the vehicle ID is 'S001', in the present example. Server 60 generates HTML data including these information thus obtained; transmits HTTP response r13 including the HTML data to mobile station 10; and stores a record containing the query date (Jan. 27, 2003, in the present example), the passenger ID 'nakamura', the area code 'AREA0001', the landmark name 'Akasaka international building' and the vehicle ID 'S001'.

Figure 14:
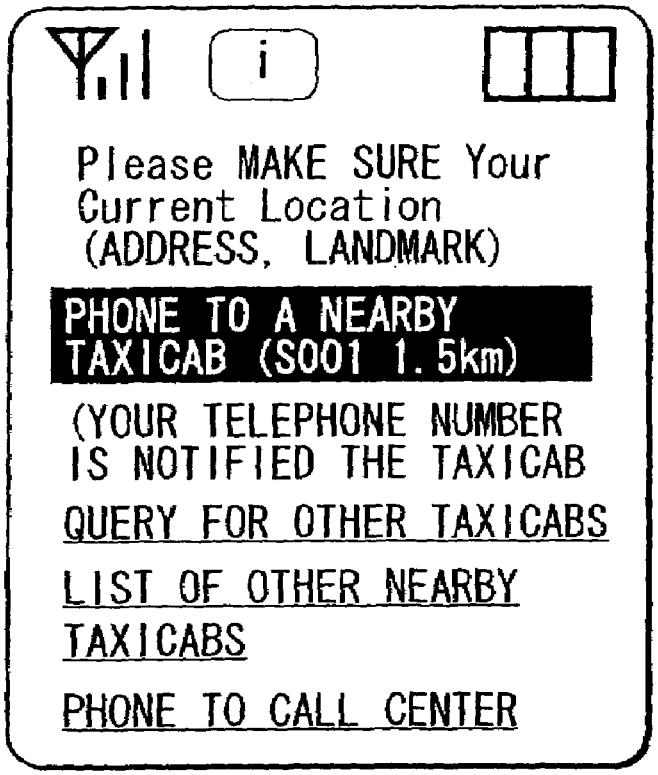

Mobile station 10 interprets the HTML data included in the received HTTP response r13, and displays a screen image as shown in FIG. 14. The item 'Call near taxicab ('S001': 1.5 kilometer distance)' is associated with the telephone number '090 ( - - - ) - - - ' of mobile station 23 carried by the driver of the vehicle 20 having the vehicle ID 'S001'.

Figure 15:
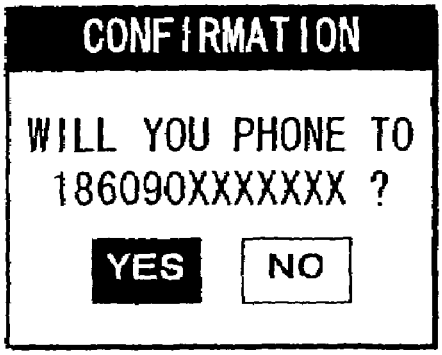

When the passenger manipulates the predetermined steps to select the item, mobile station 10, then, displays the confirmation dialog as shown in FIG. 15. When the passenger manipulates the predetermined steps to select 'Yes' in FIG. 15 so as to confirm, mobile station 10 disconnects the wireless packet communication link to server 60. Mobile station 10 transmits paging request r14 including the telephone number '090 ( - - - ) - - - ' to network 30, so as to page mobile station 23 carried by the driver of the vehicle.

The network 30 receives paging request r14 and pages mobile station 23 carried by the driver. Thus, the connection is established between mobile station 10 carried by the passenger and mobile station 23 carried by the driver. Accordingly, the passenger and the driver may telephone each other, so that they may exchange detailed information, such as the precise locations of the passenger and/or the landmark The above mentioned method enables the passenger and the driver to communicate each other directly in dispatching vehicle 20. In the ordinal method, on the contrary, a call center responsible for dispatching a car provides information, required to dispatch a car to a passenger, only to the drive of the car, once the call center receives a request from the passenger. Thus, the above mentioned method has more advantage in the quality of communicating than a ordinal method of a call center; and is useful to both of the passenger and the driver.

As described above, a passenger may contact with the driver of vehicle 20 by manipulating the predetermined steps to select one vehicle 20, for example, designated by the vehicle ID 'S001' as shown in FIG. 13. Mobile station 10, then, transmits HTTP requests to and receives HTTP responses from server 60, so as to display the screen image for calling the driver of a taxicab as shown in FIG. 14. However, in some occasions, a passenger may wish to dispatch not a single vehicle 20 but a plurality of vehicles 20.

Figure 16:
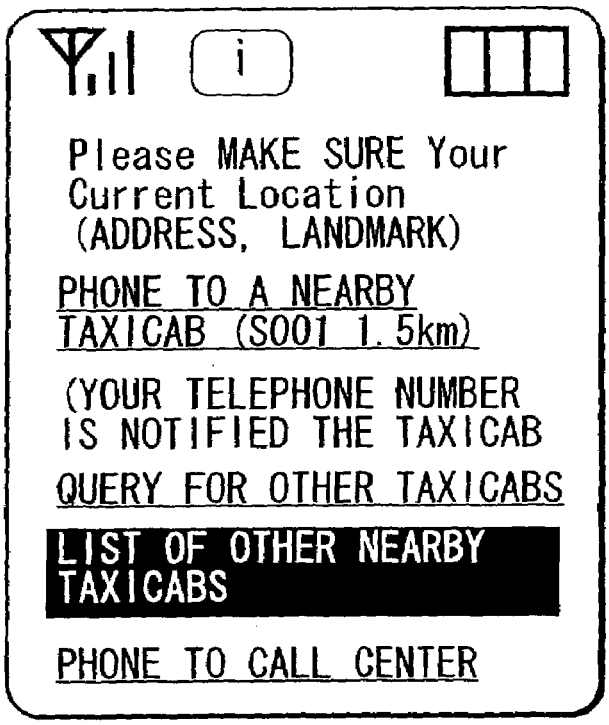
Figure 17:
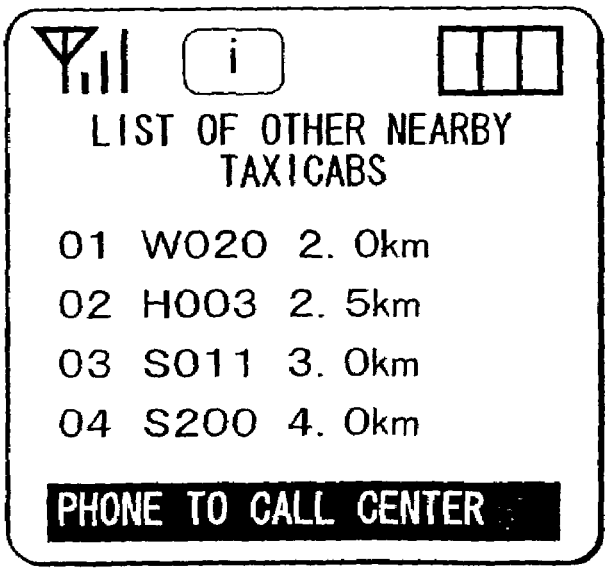

In such a case, the passenger manipulates the predetermined steps to select the item 'list of other available vehicle' as shown in FIG. 16. Mobile station 10 transmits HTTP request to server 60. On receiving the HTTP request, server 60 extracts a plurality of vehicles 20 (four, in the present example), which are the second, the third, . . . , most proximately located vehicles 20 to the landmark, and which does not include the most proximate vehicle 20 designated by the vehicle ID 'S001' shown in FIG. 14. Server 60 generates HTML data by using these vehicle ID's, and transmits HTTP response including the HTML data to mobile station 10. Mobile station 10 interprets the HTML data included in the received HTTP response, and shows a screen image as shown in FIG. 17. The passenger memorizes the plurality of vehicle ID's shown in FIG. 17, and manipulates the predetermined steps to select the item 'phone to call center'. Mobile station 10 connects a wireless telephone link with the call center, which is not shown in FIG. 1. The passenger, then, may ask an operator at the call center to dispatch the plurality of vehicles 20, for example, by appointing vehicles 20 with the vehicle ID's memorized.

Figure 18:
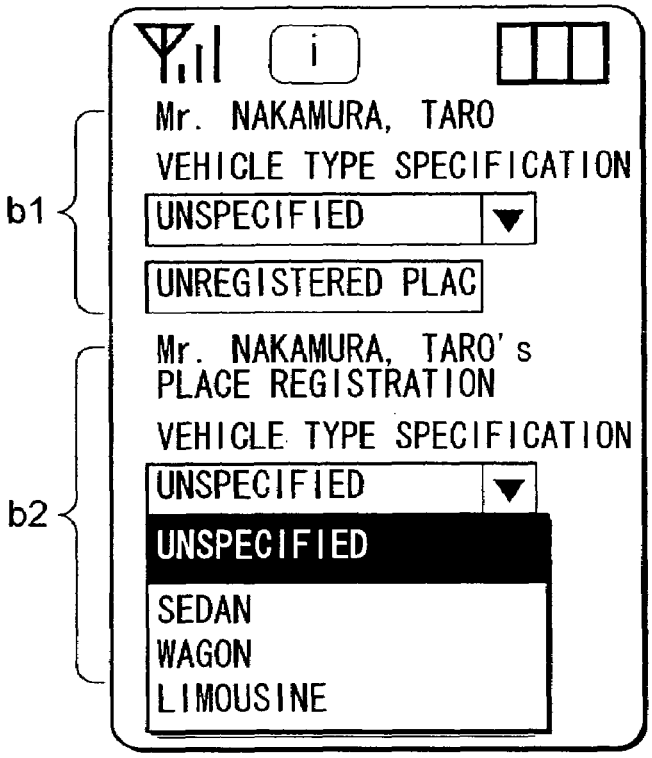
Figure 19:
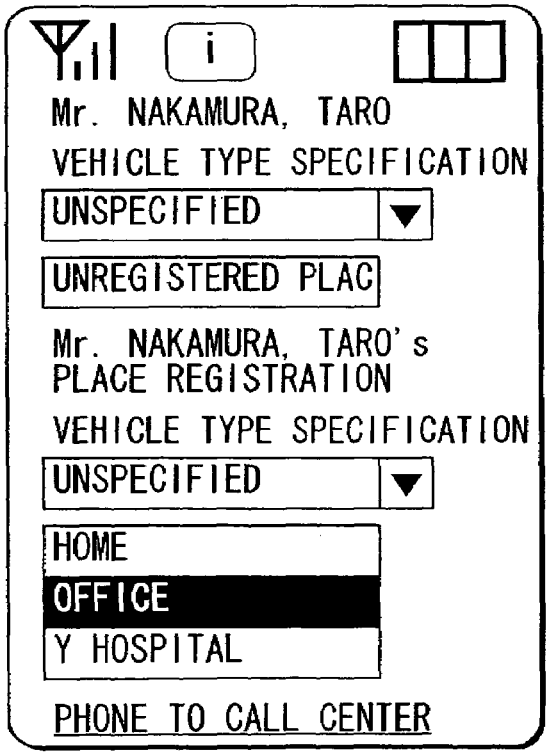

Further, in some occasions, a passenger may search vehicle 20 proximate to a pre-registered landmark, as described above, and ask to dispatch vehicle 20 there. In the present example, the passenger manipulates the predetermined steps to select 'unspecified' to the type of vehicle in the portion b2 of FIG. 18, and to select the item 'work place' as shown in FIG. 19. Mobile station 10, then, transmits HTTP request including the passenger ID 'nakamura', the type of vehicle 'unspecified', and the registered landmark 'work place' to server 60. On receiving the HTTP request, server 60 extracts the passenger ID 'nakamura', the type of vehicle 'unspecified', and the registered landmark 'work place' from the HTTP request. Server 60 reads out the location coordinates of the registered landmark 'work place' corresponding to the passenger ID 'nakamura' from the passenger database. Server 60 calculates the distances between the registered landmark 'work place' and vehicle 20, on the basis of the location coordinates of the registered landmark 'work place' and those of vehicle 20, from the vehicle database as shown in FIG. 3. Following steps are similar to those explained above. Thus, a passenger may ask to dispatch vehicle 20 which is located proximate to one of the registered landmarks.

As described above, the method according to the present embodiment enables the passenger and the driver to communicate with each other directly, thus has an advantage in the quality of communicating. Server 60 estimates an approximate location of a passenger on the basis of the area code transmitted from server 40 via mobile station 10; and transmits a list of landmarks locates in the area corresponding to the approximate location, and the list is thereby provided to the passenger carrying mobile station 10. Therefore, the passenger may select his or her desired landmark for the location to which vehicle 20 should be dispatched. Server 60 determines the location of the landmark designated by the passenger by referring to the landmark database, and determines a plurality of vehicles 20 located proximate to the landmark by referring to the vehicle database. Server 60 transmits information on the plurality of vehicles 20 to mobile station 10, and the information is thereby provided to the passenger. Therefore, the passenger may select his or her desired vehicle 20 from the plurality of vehicles 20. Thus, the present invention enables to accomplish a service requiring relatively precise location measurement so that a taxicab is dispatched to a location where a passenger is waiting for it.

C. Modifications

The present invention is not restricted to the above mentioned embodiment. For example the following modifications may be applicable.

C-1. In the above described embodiment, the location of vehicle 20 is calculated by using GPS measurement. However, the location of vehicle 20 may be calculated by using the location of the wireless communication cell, where mobile station 22 installed in the vehicle 20 is located. A network based GPS technique may also be used to obtain the location of vehicle 20. In the network based GPS technique, output results calculated by a GPS measurement unit are corrected by the unit installed in the network, thus more accurate location of the car is obtainable.

C-2: In the above described embodiment, the list of the areas is first provided to the passenger, and then the list of the landmarks is provided. Namely, these lists are configured in a two layer format of lists. However, these lists may be configured in a multilayer format of lists designating areas or landmarks, if necessary. For example, the a multilayer format is used in the case that wireless communication cells corresponding to base stations have relatively large areas as in Hokkaido, or in the case that a great number of landmarks are located in the area.

C-3: In the above described embodiment, the location of base station (wireless communication cell) is used to estimate the approximate location of mobile station 10. However, the location of the facility of wireless mobile packet communication network communicating directly/indirectly with mobile station 10 may be used for this purpose. For example, the location of the switch station which performs switch operation in the wireless mobile packet communication network may be used.

C-4: In the above described embodiment, the passenger transport service is only provided to a subscribed passenger. However, a subscription is not always required for the service. A password-only authentication scheme may be used to authenticate a passenger. In such a case, mobile station 10 carried by a passenger stores other identification information beforehand, instead of the passenger ID. Mobile station 10 transmits the other identification information and the password to server 60. Server 60 authenticates the passenger on the basis of a pair of the other identification information and the password.

C-5. In the above described embodiment, vehicles 20 are classified in terms of type of vehicles: 'sedan', 'wagon', and 'limousine'; but vehicles 20 may be classified in terms of model names of the vehicle 20.

C-6: The computer program as described above for operating server 60 may be provided in the stored forms in a magnetic/optical storage medium or storage media such as ROM which are readable from CPU 61 of server 60. The computer program may be downloaded to server 60 via such a network as Internet 50.

What is claimed is:

1. A vehicle dispatch system using a wireless network comprising:

a location database which stores a list of geographical points to which vehicles are dispatchable;

a receiver configured to receive a dispatch request from a mobile terminal via the wireless network, wherein the request includes information indicative of a geographical area identified by the wireless network in which the mobile terminal is situated; and a dispatch location finder configured to determine at least one candidate geographical point, using the location database, based on the geographical area identified by the wireless network and present the at least one candidate geographical point to the mobile terminal via the wireless network in order to have a user of the mobile terminal select one of the at least one candidate geographical point to which the user wishes a vehicle dispatched.

2. A vehicle dispatch system according to claim 1, wherein the dispatch location finder comprises an area finder and a location finder, the area finder being configured to determine at least one candidate geographical area based on the geographical area identified by the wireless network and present the at least one candidate geographical area to the mobile terminal via the wireless network in order to have the user select one of the at least one candidate geographical area to which the user wishes a vehicle dispatched, and the location finder being configured to determine, using the location database, the at least one candidate geographical point found in the selected one of the at least one geographical area and present the at least one candidate geographical point to the mobile terminal via the wireless network in order to have the user select one of the at least one candidate geographical point to which the user wishes a vehicle dispatched.

3. A vehicle dispatch system according to claim 2, wherein in determining the at least one candidate geographical area, the area finder determines a first geographical area that at least partially overlaps the geographical area identified by the wireless network and a number of secondary geographical areas neighboring on the first geographical area.

4. A vehicle dispatch system according to claim 1, further comprising:

a vehicle database which stores locations of vehicles; and a vehicle finder configured to determine, using the vehicle database, at least one vehicle dispatchable to the selected one of the at least one candidate geographical point.

5. A vehicle dispatch system according to claim 4, wherein the at least one vehicle dispatchable to the selected one of the at least one candidate geographical point is determined, based on a distance between a location of the at least one vehicle stored in the vehicle database and the selected one of the at least one candidate geographical point.

6. A vehicle dispatch system according to claim 4, wherein the vehicle finder notifies the mobile terminal via the wireless network of a communication address of the at least one dispatchable vehicle which is reachable from the mobile terminal.

7. A vehicle dispatch system according to claim 6, wherein the communication address is a telephone number of a telephone equipped with the at least one dispatchable vehicle.

8. A vehicle dispatch system according to claim 4, wherein the vehicle finder notifies the mobile terminal via the wireless network of a vehicle type of the at least one dispatchable vehicle which is reachable from the mobile terminal.

9. A vehicle dispatch method using a wireless network comprising:

providing a location database which stores a list of geographical points to which vehicles are dispatchable;

receiving a dispatch request from a mobile terminal via the wireless network, wherein the request includes information indicative of a geographical area identified by the wireless network in which the mobile terminal is situated;

determining at least one candidate geographical point, using the location database, based on the geographical area identified by the wireless network; and presenting the at least one candidate geographical point to the mobile terminal via the wireless network in order to have a user of the mobile terminal select one of the at least one candidate geographical point to which the user wishes a vehicle dispatched.

10. A vehicle dispatch method according to claim 9, wherein determining at least one candidate geographical point comprises:

determining at least one candidate geographical area based on the geographical area identified by the wireless network;

presenting the at least one candidate geographical area to the mobile terminal via the wireless network in order to have the user select one of the at least one candidate geographical area to which the user wishes a vehicle dispatched; and determining, using the location database, the at least one candidate geographical point found in selected one of the at least one candidate geographical area.

11. A vehicle dispatch method according to claim 10, wherein determining at least one candidate geographical area comprises determining a first geographical area that at least partially overlaps the geographical area identified by the wireless network and a number of secondary geographical areas neighboring on the first geographical area.

12. A vehicle dispatch method according to claim 9, further comprising:

providing a vehicle database which stores locations of vehicles; and determining, using the vehicle database, at least one vehicle dispatchable to the selected one of the at least one candidate geographical point.

13. A vehicle dispatch method according to claim 12, wherein the at least one vehicle dispatchable to the selected one of the at least one candidate geographical point is determined, based on a distance between a location of the at least one vehicle stored in the vehicle database and the selected one of the at least one candidate geographical point.

14. A vehicle dispatch method according to claim 12, further comprising notifying the mobile terminal via the wireless network of a communication address of the at least one dispatchable vehicle which is reachable from the mobile terminal.

15. A vehicle dispatch method according to claim 14, wherein the communication address is a telephone number of a telephone equipped with the at least one dispatchable vehicle.

16. A vehicle dispatch method according to claim 12, further comprising notifying the mobile terminal via the wireless network of a vehicle type of the at least one dispatchable vehicle which is reachable from the mobile terminal.

17. A vehicle dispatch system using a wireless network comprising:

a user database which stores for each user a list of at least one geographical point to which a respective user wishes a vehicle dispatched;

a receiver configured to receive a dispatch request from a mobile terminal via the wireless network and authenticate a user of the mobile terminal, wherein the request includes information indicative of a geographical area identified by the wireless network in which the mobile terminal is situated; and a dispatch location finder configured to present the list of at least one geographical point stored for the user to the mobile terminal via the wireless network in order to have the user select one of the at least one geographical point to which the user wishes a vehicle dispatched.

18. A vehicle dispatch system according to claim 17, further comprising:

a vehicle database which stores locations of vehicles; and a vehicle finder configured to determine, using the vehicle database, at least one vehicle dispatchable to the selected one of the at least one geographical point.

19. A vehicle dispatch system according to claim 18, wherein the at least one vehicle dispatchable to the selected one of the at least one geographical point is determined, based on a distance between a location of the at least one vehicle stored in the vehicle database and the selected one of the at least one geographical point.

20. A vehicle dispatch system according to claim 18, wherein the vehicle finder notifies the mobile terminal via the wireless network of a communication address of the at least one dispatchable vehicle which is reachable from the mobile terminal.

21. A vehicle dispatch system according to claim 20, wherein the communication address is a telephone number of a telephone equipped with the at least one dispatchable vehicle.

22. A vehicle dispatch system according to claim 18, wherein the vehicle finder notifies the mobile terminal via the wireless network of a vehicle type of the at least one dispatchable vehicle which is reachable from the mobile terminal.

23. A vehicle dispatch method using a wireless network comprising:

providing a user database which stores for each user a list of at least one geographical point to which a respective user wishes a vehicle dispatched;

receiving a dispatch request from a mobile terminal via the wireless network and authenticating a user of the mobile terminal, wherein the request includes information indicative of a geographical area identified by the wireless in which the mobile terminal is situated; and presenting the list of at least one geographical point stored for the user to the mobile terminal via the wireless network in order to have the user select one of the at least one geographical point to which the user wishes a vehicle dispatched.

24. A vehicle dispatch method according to claim 23, further comprising:

providing a vehicle database which stores locations of vehicles; and determining, using the vehicle database, at least one vehicle dispatchable to the selected one of the at least one geographical point.

25. A vehicle dispatch method according to claim 24, wherein the at least one vehicle dispatchable to the selected one of the at least one geographical point is determined, based on a distance between a location of the at least one vehicle stored in the vehicle database and the selected one of the at least one geographical point.

26. A vehicle dispatch method according to claim 24, further comprising notifying the mobile terminal via the wireless network of a communication address of the at least one dispatchable vehicle which is reachable from the mobile terminal.

27. A vehicle dispatch method according to claim 26, wherein the communication address is a telephone number of a telephone equipped with the at least one dispatchable vehicle.

28. A vehicle dispatch system according to claim 24, wherein the vehicle finder notifies the mobile terminal via the wireless network of a vehicle type of the at least one dispatchable vehicle which is reachable from the mobile terminal.

* * * * *